US011719457B2

(12) United States Patent
Delgoshaei et al.

(10) Patent No.: US 11,719,457 B2
(45) **Date of Patent: *Aug. 8, 2023**

(54) HVAC SYSTEM AND METHOD FOR DETERMINING A TEMPERATURE OFFSET BETWEEN A DISCHARGED AIR TEMPERATURE AND AN INDOOR TEMPERATURE

(71) Applicant: Lennox Industries Inc., Richardson, TX (US)

(72) Inventors: Payam Delgoshaei, Addison, TX (US); Glenn W. Kowald, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 78 days.

This patent is subject to a terminal disclaimer.

(21) Appl. No.: 17/401,546

(22) Filed: Aug. 13, 2021

(65) Prior Publication Data

US 2021/0372651 A1 Dec. 2, 2021

Related U.S. Application Data

(63) Continuation of application No. 16/847,015, filed on Apr. 13, 2020, now Pat. No. 11,143,425.

(51) Int. Cl.
*F24F 11/64* (2018.01)
*F24F 11/81* (2018.01)
(Continued)

(52) U.S. Cl.
CPC ..... *F24F 11/64* (2018.01); *F24F 11/38* (2018.01); *F24F 11/81* (2018.01); *F24F 2110/12* (2018.01); *F24F 2110/30* (2018.01)

(58) Field of Classification Search
CPC .. F24F 11/64; F24F 11/81; F24F 11/38; F24F 2110/30; F24F 2110/12
(Continued)

(56) References Cited

U.S. PATENT DOCUMENTS 9,447,985 B2 9/2016 Johnson, Jr.
10,871,756 B2 12/2020 Johnson, Jr. et al.
(Continued)

FOREIGN PATENT DOCUMENTS

CA 3043996 A1 2/2018

OTHER PUBLICATIONS

Delgoshaei, P. et al., "Determination of Return Air Temperature," U.S. Appl. No. 16/847,015, filed Apr. 13, 2020, 39 pages.
(Continued)

*Primary Examiner* — Jigneshkumar C Patel
(74) *Attorney, Agent, or Firm* — Baker Botts L.L.P.

(57) ABSTRACT

An HVAC system includes a blower configured to provide a flow of air into a conditioned space. A temperature sensor measures a discharge air temperature of the flow of air provided to the conditioned space. The blower provides the flow of air at a predefined flow rate. The controller determines that the measured discharge air temperature satisfies predefined stability criteria associated with a change in the discharge air temperature during a first period of time being less than a threshold value. If the stability criteria are satisfied, a temperature offset is determined between the discharge air temperature and an indoor temperature. The temperature offset is stored in a memory and is associated with the flow rate of air provided by the blower and the outdoor temperature.

20 Claims, 5 Drawing Sheets

(51) Int. Cl.
*F24F 11/38* (2018.01)
*F24F 110/12* (2018.01)
*F24F 110/30* (2018.01)

(58) Field of Classification Search
USPC ..... 700/276
See application file for complete search history.

(56) References Cited

U.S. PATENT DOCUMENTS

| | | | |
|---|---|---|---|
| 10,908,578 | B2 | 2/2021 | Johnson, Jr. et al. |
| 10,921,768 | B2 | 2/2021 | Johnson, Jr. et al. |
| 11,156,978 | B2 | 10/2021 | Johnson, Jr. et al. |
| 2007/0107450 | A1 | 5/2007 | Sasao et al. |
| 2007/0205297 | A1 | 9/2007 | Finkam et al. |
| 2017/0211833 | A1 | 7/2017 | Tran et al. |
| 2021/0356927 | A1 | 11/2021 | Johnson, Jr. |

OTHER PUBLICATIONS

Johnson, Jr. David, Letter re Duty of Disclosure of Prior Art Material to Patentability dated Oct. 18, 2022.

152

| 148 AIR FLOW RATE (CFM) | 146 OUTDOOR TEMPERATURE (°F) | 154 AIR TEMPERATURE OFFSET (°F) |
|---|---|---|
| 1000 | 65 | 1 |
| 1000 | 70 | 2 |
| 1000 | 80 | 5 |
| 1000 | 90 | 6 |
| ⋮ | ⋮ | ⋮ |
| 1500 | 65 | 0.5 |
| 1500 | 70 | 1 |
| ⋮ | ⋮ | ⋮ |
| 2000 | 65 | 0.2 |
| ⋮ | ⋮ | ⋮ |

*FIG. 2*

HVAC SYSTEM AND METHOD FOR DETERMINING A TEMPERATURE OFFSET BETWEEN A DISCHARGED AIR TEMPERATURE AND AN INDOOR TEMPERATURE

CROSS-REFERENCE TO RELATED APPLICATIONS

This application is a continuation of U.S. patent application Ser. No. 16/847,015 filed Apr. 13, 2020, by Payam Delgoshaei et al., and entitled "DETERMINATION OF RETURN AIR TEMPERATURE," which is incorporated herein by reference.

TECHNICAL FIELD

The present disclosure relates generally to heating, ventilation, and air conditioning (HVAC) systems and methods of their use. In particular, the present disclosure relates to the determination of return air temperature.

BACKGROUND

Heating, ventilation, and air conditioning (HVAC) systems are used to regulate environmental conditions within an enclosed space. In a cooling mode, air is cooled via heat transfer with refrigerant flowing through the HVAC system and returned to the enclosed space as cooled conditioned air. In a heating mode, air is heated via heat transfer with a heating element and returned to the enclosed space as heated conditioned air.

SUMMARY OF THE DISCLOSURE

In an embodiment, a heating, ventilation, and air conditioning (HVAC) system includes a blower configured to provide a flow of air through at least one air duct and into a conditioned space. The system includes a temperature sensor positioned and configured to measure a discharge air temperature of the flow of air provided to the conditioned space. A controller of the HVAC system determines that heating or cooling mode operation is not requested. Following determining that heating or cooling mode operation is not requested, the blower is caused to provide the flow of air at a first flow rate. Following causing the blower to provide the flow of air at the first flow rate, the controller receives, from the temperature sensor over a first period of time, measurements of the discharge air temperature. The controller determines that the measured discharge air temperature satisfies predefined stability criteria associated with a change in the discharge air temperature during the first period of time being less than a threshold value. In response to determining that the measured discharge air temperature satisfies the predefined stability criteria, a first temperature offset is determined. The first temperature offset includes a difference between the discharge air temperature following the first period of time and an indoor temperature at a corresponding time point. A first outdoor temperature is determined. The first temperature offset is stored in a lookup table such that the stored first temperature offset is associated with the first flow rate of the flow of air provided by the blower and the first outdoor temperature.

During operation of an HVAC system return air is pulled from a space being conditioned into ducts and directed across cooling and/or heating elements to condition the air. Knowledge of the temperature of this return air can be helpful for identifying possible system faults and/or adjusting operation of the system to improve performance of cooling and/or heating. However, in many cases, it is not possible to directly measure the temperature of return air. For instance, many HVAC systems do not include a sensor appropriately positioned (e.g., disposed inside return ducts) to measure return air temperature. Such sensors may be absent, for example, because of constraints on system design, cost, signal processing limitations (e.g., limits on available sensor inputs), and the like.

This disclosure not only encompasses the recognition that the return air temperature is a useful system parameter for identifying system faults and improving system performance but also provides an approach to determining return air temperature when a return air temperature sensor is unavailable (i.e., when an HVAC system does not include a return air temperature sensor and/or when such a sensor malfunctions). As described further below, a controller of an HVAC system may be configured to automatically record temperature measurements under appropriate operating conditions such that a lookup table can be established (e.g., and continuously updated) to indirectly determine the return air temperature from measurements of the indoor temperature.

As described further below, when the HVAC system is not operating to provide heating or cooling, airflow is provided through the HVAC system (i.e., by turning on a blower of the HVAC system), and the discharge air temperature is measured. This disclosure encompasses the recognition that the discharge air temperature is substantially the same as, or with a threshold range of, the return air temperature when the HVAC system has not been providing heating or cooling for a period of time (e.g., of about ten minutes or so). Thus, under these operating conditions (i.e., with no heating or cooling is provided), the discharge air temperature may act as a proxy for the return air temperature. The controller may store an offset between a measured indoor air temperature (e.g., measured by a thermostat) and a measured discharge air temperature which acts as a proxy for the return air temperature. In some embodiments, the offsets are determined for a range of operating conditions (e.g., outdoor temperature, blower air flow rates, etc.) and stored in a lookup table. When a return air temperature is requested during subsequent operation of the HVAC system (e.g., to identify any possible fault of the HVAC system and/or modify operation of the HVAC system for improved performance and/or efficiency), the controller may access the appropriate offset from the lookup table and use this offset along with a known indoor temperature to determine the current return air temperature. As such, the system described in this disclosure for determining a return air temperature without a dedicated return air temperature sensor may improve the technology used to efficiently operate HVAC systems. The controller described in this disclosure may particularly be implemented in the practical application of determining return air temperatures in HVAC systems which lack a dedicated return air temperature sensor (i.e., a temperature disposed on, in, or near a return air duct of the HVAC system).

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which:

FIG. 2 is a table illustrating an example portion of a lookup table of FIG. 1;

DETAILED DESCRIPTION

Embodiments of the present disclosure and its advantages are best understood by referring to FIGS. 1 through 5 of the drawings, like numerals being used for like and corresponding parts of the various drawings.

As described above, prior to this disclosure, there was a lack of tools for reliably determining return air temperatures in HVAC systems that lack a dedicated return air temperature sensor. Many HVAC systems do not have return air temperature sensors because of the limited number of sensor inputs available, the cost of such sensors, and/or other constraints preventing the use of a dedicated return air temperature sensor. Without information about the return air temperature, HVAC system faults may go undetected until it is too late to take efficient corrective measures (e.g., before more costly damage to one or more components of the HVAC system and/or before substantial down time is required for repairs). However, when return air temperature is known (i.e., as is facilitated via the system described in this disclosure), system faults may be proactively detected. Moreover, when return air temperature is known, operating parameters of the HVAC system (e.g., settings of a compressor, blower, expansion valve, etc.) may be adjusted to improve efficiency and/or air conditioning performance.

HVAC System

Figure 1:
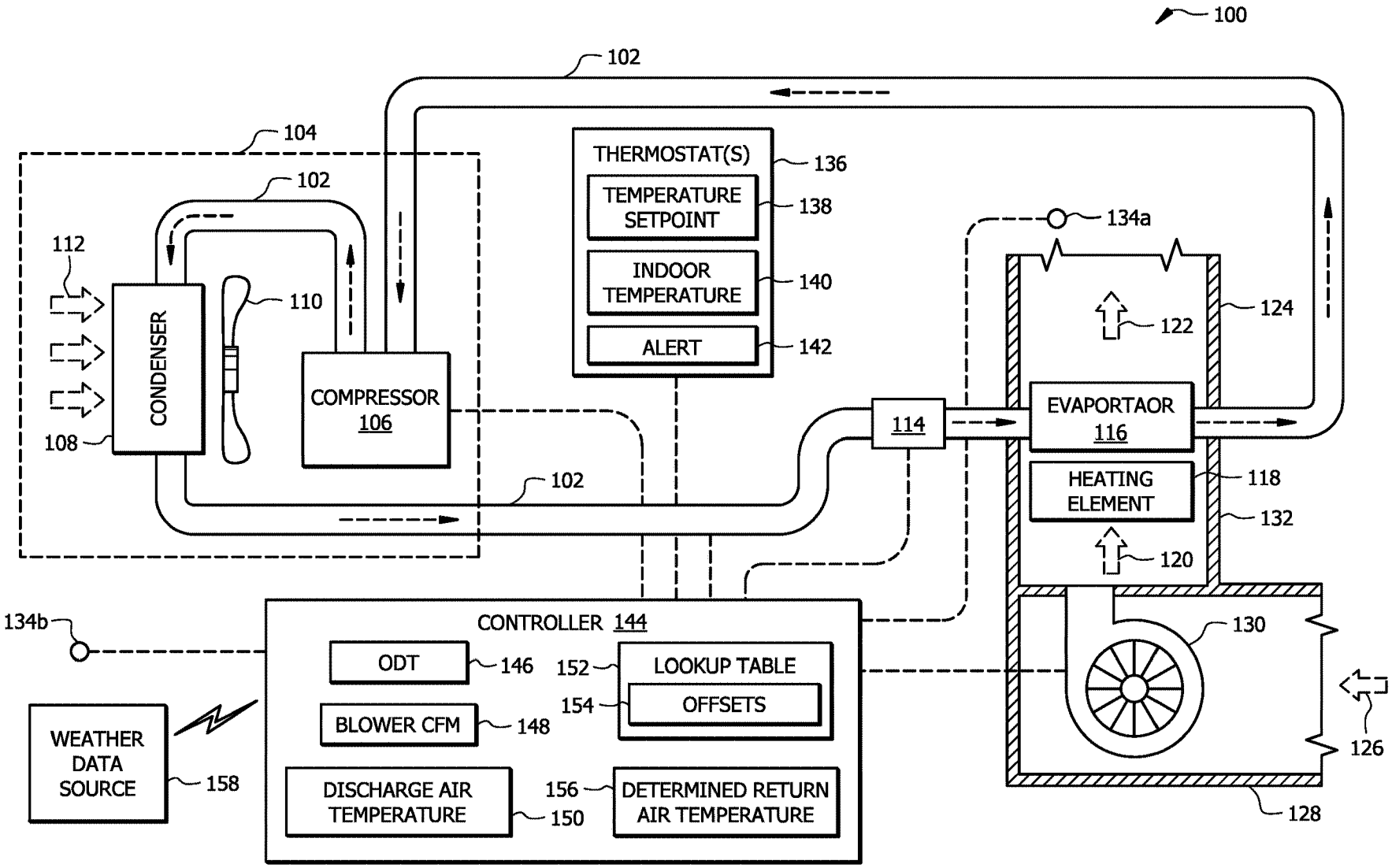
FIG. 1 is a diagram of an example HVAC system configured for indirect return air temperature determination.

FIG. 1 is a schematic diagram of an example HVAC system 100 configured to allow return air temperatures 156 to be determined based on information in a lookup table 152 may be when the HVAC system 100 is not operated to provide heating or cooling. The HVAC system 100 generally conditions air for delivery to a space. The space may be, for example, a room, a house, an office building, a warehouse, or the like. In some embodiments, the HVAC system 100 is a rooftop unit (RTU) that is positioned on the roof of a building and conditioned air 122 is delivered to the interior of the building. In other embodiments, portion(s) of the HVAC system 100 may be located within the building and portion(s) outside the building. The HVAC system 100 may be configured as shown in FIG. 1 or in any other suitable configuration. For example, the HVAC system 100 may include additional components or may omit one or more components shown in FIG. 1.

The HVAC system 100 includes a working-fluid conduit subsystem 102, at least one condensing unit 104, an expansion device 114, an evaporator 116, a heating element 118, a blower 130, one or more thermostats 136, and a controller 144. The controller 144 of the HVAC system 100 is generally configured to establish a lookup table 152 of temperature offset values 154 and automatically employ these offsets 154 to determine return air temperature 156 (i.e., for airflow 126) when requested. Temperature offsets 154 are generally determined from measurements of the temperature 150 of the discharge air 122 (i.e., via discharge air temperature sensor 134*a*) and an indoor temperature 140 (e.g., determined by a thermostat 136). The offset values 154 generally facilitate the determination of a return air temperature 156 based on a measured indoor temperature 140 (e.g., measured via a thermostat 136). In some embodiments, the lookup table 152 includes multiple temperature offsets 154, and each temperature offset 154 is associated with a particular set of operating conditions, such as with a particular combination of outdoor temperature 146 and blower air flow rate 148 (see example lookup table of FIG. 2 described further below). The controller 144 is described in greater detail below with respect to FIG. 5.

The working-fluid conduit subsystem 102 facilitates the movement of a working fluid (e.g., a refrigerant) through a cooling cycle such that the working fluid flows as illustrated by the dashed arrows in FIG. 1. The working fluid may be any acceptable working fluid including, but not limited to, fluorocarbons (e.g. chlorofluorocarbons), ammonia, non-halogenated hydrocarbons (e.g. propane), hydroflurocarbons (e.g. R-410A), or any other suitable type of refrigerant.

The condensing unit 104 includes a compressor 106, a condenser 108, and a fan 110. In some embodiments, the condensing unit 104 is an outdoor unit while other components of the HVAC system 100 may be located indoors. The compressor 106 is coupled to the working-fluid conduit subsystem 102 and compresses (i.e., increases the pressure of) the working fluid. The compressor 106 of condensing unit 104 may be a single-speed, variable-speed, or multiple stage compressor. A single-speed compressor is generally configured to operate at a single speed. A variable-speed compressor is generally configured to operate at different speeds to increase the pressure of the working fluid to keep the working fluid moving along the working-fluid conduit subsystem 102. In the variable-speed compressor configuration, the speed of compressor 106 can be modified to adjust the cooling capacity of the HVAC system 100. Meanwhile, in the multi-stage compressor configuration, one or more compressors can be turned on or off to adjust the cooling capacity of the HVAC system 100.

The compressor 106 is in signal communication with the controller 144 using wired and/or wireless connection. The controller 144 provides commands or signals to control operation of the compressor 106 and/or receives signals from the compressor 106 corresponding to a status of the compressor 106. For example, the controller 144 may transmit signals to adjust compressor speed. The controller 144 may operate the compressor 106 in different modes corresponding, for example, to a user-requested mode, to load conditions (e.g., the amount of cooling or heating requested by the HVAC system 100), or the like. The temperature offsets 154 are only determined if the compressor 106 is turned off. In some embodiments, the temperature offsets 154 are only determined if the compressor 106 has been turned off for at least a threshold time (e.g., of 10 minutes or so).

The condenser 108 is configured to facilitate movement of the working fluid through the working-fluid conduit subsystem 102. The condenser 108 is generally located downstream of the compressor 106 and is configured, when the HVAC system 100 is operating in a cooling mode, to remove heat from the working fluid. The fan 110 is configured to move air 112 across the condenser 108. For example, the fan 110 may be configured to blow outside air through the condenser 108 to help cool the working fluid flowing therethrough. The compressed, cooled working fluid flows from the condenser 108 toward the expansion device 114.

The expansion device 114 is coupled to the working-fluid conduit subsystem 102 downstream of the condenser 108 and is configured to remove pressure from the working fluid. In this way, the working fluid is delivered to the evaporator 116 and receives heat from airflow 120 to produce a conditioned discharge airflow 122 that is delivered by a duct subsystem 124 to the conditioned space. In general, the expansion device 114 may be a valve such as an expansion valve or a flow control valve (e.g., a thermostatic expansion valve) or any other suitable valve for removing pressure from the working fluid while, optionally, providing control of the rate of flow of the working fluid. The expansion device 114 may be in communication with the controller 144 (e.g., via wired and/or wireless communication) to receive control signals for opening and/or closing associated valves and/or provide flow measurement signals corresponding to the rate of working fluid through the working-fluid conduit subsystem 102.

The evaporator 116 is generally any heat exchanger configured to provide heat transfer between air flowing through (or across) the evaporator 116 (i.e., air contacting an outer surface of one or more coils of the evaporator 116) and working fluid passing through the interior of the evaporator 116, when the HVAC system 100 is operated in the cooling mode. The evaporator 116 may include one or more circuits. The evaporator 116 is fluidically connected to the compressor 106, such that working fluid generally flows from the evaporator 116 to the condensing unit 104. A portion of the HVAC system 100 is configured to move air 120 across the evaporator 116 and out of the duct sub-system 124 as conditioned air 122.

The heating element 118 is generally any device for heating the flow of air 120 and providing heated air 122 to the conditioned space, when the HVAC system 100 is configured to operate in a heating mode. For example, the heating element 118 may be a furnace, an electrical heater (e.g., comprising one or more resistive elements), or a heat pump configured to heat the flow of air 120 passing therethrough. The heating element 118 may be in communication with the controller 144 (e.g., via wired and/or wireless communication) to receive control signals for activating the heating element 118 to heat the flow of air 120, when the HVAC system 100 is operated in a heating mode. Generally, when the HVAC system 100 is operated in the heating mode, the heating element 118 and blower 130 are turned on such that the flow of air 120 is provided across and heated by the heating element 118. When the HVAC system 100 is operated in a cooling mode, the heating element 118 is generally turned off (i.e., such that the flow of air 120 is not heated). The temperature offsets 154 are only determined if the heating element 118 is turned off In some embodiments, the temperature offsets 154 are only determined if the heating element 118 has been turned off for at least a threshold time (e.g., of 10 minutes or so).

Return air 126, which may be air returning from the building, air from outside, or some combination, is pulled into a return duct 128. As described elsewhere in this disclosure, the temperature of the return air 126 may be used to detect faults of the HVAC system 100 and/or adjust operation of the HVAC system 100 (e.g., to improve efficiency and/or performance of heating or cooling mode operation). The HVAC system 100 generally does not include a sensor positioned to measure the temperature of the return air 126. A suction side of the blower 130 pulls the return air 126 into the return duct 128. The blower 130 discharges air 120 into a duct 132 such that air 120 crosses the evaporator 116 and/or heating element 118 to produce conditioned air 122. The blower 130 is any mechanism for providing a flow of air through the HVAC system 100. For example, the blower 130 may be a constant-speed or variable-speed circulation blower or fan. Examples of a variable-speed blower include, but are not limited to, belt-drive blowers controlled by inverters, direct-drive blowers with electronic commuted motors (ECM), or any other suitable type of blower. The blower 130 is in signal communication with the controller 144 using any suitable type of wired and/or wireless connection. The controller 144 is configured to provide commands and/or signals to the blower 130 to control its operation (e.g., to set and/or determine blower air flow rate 148).

The HVAC system 100 includes sensors 134*a,b* in signal communication with the controller 144. Sensors 134*a,b* may include any suitable type of sensor for measuring air temperature, relative humidity, and/or any other properties associated with the conditioned space. As shown in the illustrative example of FIG. 1, the HVAC system 100 includes sensor 134*a* positioned and configured to measure a discharge air temperature 150 (e.g., a temperature of airflow 122). Example sensor 134*b* is positioned and configured to measure an outdoor air temperature (ODT) 146. While the example system 100 shows the sensor 134*b* to measure the outdoor temperature 146, it should be understood that the outdoor temperature 146 may be provided by any other source of outdoor temperature information, such as the example weather data source 158. For instance, the controller 144 may be connected to a network and configured to pull and/or receive data about current and/or forecasted temperature information from the weather data source 158. Signals corresponding to the properties measured by sensors 134*a,b* may be provided to the controller 144 via wired and/or wireless communication. In other examples, the HVAC system 100 may include other sensors (not shown for clarity and conciseness) positioned and configured to measure any other suitable property associated with operation of the HVAC system 100 (e.g., the temperature and/or relative humidity of air at one or more particular locations within the conditioned space and/or in the surrounding environment).

The HVAC system 100 includes one or more thermostats 136, for example, located within the conditioned space (e.g. a room or building). The thermostat(s) 136 are generally in signal communication with the controller 144 using any suitable type of wired and/or wireless connection. In some embodiments, one or more functions of the controller 144 may be performed by the thermostat(s) 136. For example, the thermostat 136 may include the controller 144. The thermostat(s) 136 may include one or more single-stage thermostats, one or more multi-stage thermostats, and/or any other suitable type of thermostat(s). The thermostat(s) 136 are configured to allow a user to input a desired temperature or temperature setpoint 138 for the conditioned space and/or for a designated space or zone, such as a room, in the conditioned space. The thermostat 136 generally includes (e.g., or is communicatively connected to) a sensor for measuring an indoor temperature 140.

Information from the thermostat(s) 136 such as the temperature setpoint 138 and indoor temperature 140 are generally used by the controller 144 in order to control the compressor 106, the fan 110, the expansion device 114, the heating element 18, and/or the blower 130. In some embodiments, a thermostat 136 includes a user interface and/or display for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for display of an alert 142 and/or any other messages related to the status and/or operation of the HVAC system 100. The alert 142 may be associated with an error determining the return air temperature 156 and/or with the determined return air temperature 156 being outside a predefined range of values. In some embodiments, the alert 142 may be provided (e.g., via a network) for display on another device (e.g., a device associated with a maintenance provider). This may facilitate proactive repairs of the HVAC system 100, such that there is limited or no downtime during which desired cooling or heating is not available.

As described in greater detail below, the controller 144 is configured to determine temperature offsets 154 based on discharge temperatures 150 measured when the HVAC system 100 is not operated in a heating or cooling mode. Each offset 154 generally corresponds to the difference between the determined return air temperature 156 and the indoor temperature 140 for a given set of operating conditions (e.g., outdoor temperature 146 and blower air flow rate 148). When the HVAC system 100 is later operated in the heating or cooling mode, the controller 144 may access an appropriate offset 154 (e.g., based on the current outdoor temperature 146 and/or blower air flow rate 148), and use the offset 154 to determine the return air temperature 156 based on the indoor temperature 140. Thus, the return air temperature 156 can be accurately determined without a separate sensor being positioned within the return duct 128 (e.g., and without the cost and signal processing overhead associated with such a sensor).

As described above, in certain embodiments, connections between various components of the HVAC system 100 are wired. For example, conventional cable and contacts may be used to couple the controller 144 to the various components of the HVAC system 100, including, the compressor 106, the fan 110, the expansion device 114, heating element 118, sensors 134*a,b*, blower 130, and thermostat(s) 136. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 144 to other components of the HVAC system 100.

In an example operation of HVAC system 100, the HVAC system 100 starts up to operate in a cooling mode. For example, in response to the indoor temperature 140 exceeding the temperature setpoint 138, the controller 144 may cause the compressor 106, the fan 110, and the blower 130 to turn on to start up the HVAC system 100. Once the indoor temperature 140 reaches the temperature setpoint 138, the controller 144 stops requesting cooling mode operation, and the HVAC system 100 stops providing cooling. Once cooling mode operation has stopped (e.g., for at least a threshold time of about ten minutes or so), the controller 144 may appropriately operate the HVAC system 100 to establish temperature offsets 154 to store in the lookup table 152 for future determination of return air temperature 156 while the HVAC system 100 is operated in a cooling or heating mode. The same or a similar approach may be used when the HVAC system 100 has recently stopped operating in a heating mode. For instance, once heating mode operation has stopped (e.g., for at least a threshold time of about ten minutes or so), the controller 144 may appropriately operate the HVAC system 100 to establish temperature offsets 154 to store in the lookup table 152 for future determination of return air temperature 156 while the HVAC system 100 is operated in a heating or cooling mode.

For example, the controller 144 may cause the blower 130 to provide a flow of air 120 through the HVAC system 100 while neither cooling nor heating are provided (i.e., while both the compressor 106 and heating element 118 are turned off). Since neither cooling nor heating is being provided, the discharge air temperature 150, measured by sensor 134*a*, is generally the same as or similar to the temperature of the return air 126 pulled into return duct 128 by the blower 130. The blower 130 is generally set to a desired flow rate 148 (e.g., a flow rate in units of cubic feet per minute (CFM)). If the discharge air temperature 150 satisfies predefined stability criteria, an offset 154 is determined as the difference between the discharge air temperature 150 and the indoor temperature 140. For example, if the discharge air temperature 150 changes by less than 1° F. per minute (e.g., for at least 5 minutes), then the discharge air temperature 150 may be used to determine the temperature offset 154. If the stability criteria are not satisfied, an alert 142 may be provided for presentation on a thermostat 136 in order to notify a user of the issue.

In some embodiments, multiple offsets 154 are determined, such that each offset 154 corresponds to different combinations of operating conditions. FIG. 2 shows a table illustrating a portion of an example lookup table 152 which include temperature offsets 154 (e.g., measured discharge air temperature 150 minus indoor temperature 140) at different values of blower air flow rate 148 and outdoor temperature 146. As such, at a given outdoor temperature 146, the controller 144 may measure the offset 154 at a first blower air flow rate 148, subsequently adjust the flow rate 148, wait a predetermined delay time (e.g., of about five to ten minutes or more), and determine an offset 154 for the adjusted flow rate. This process may be repeated as appropriate to populate the lookup table 152 with offsets 154. Prior to determining such offsets 154, the controller 144 may determine the current outdoor temperature 146 and determine whether offsets 154 have already been determined for the current outdoor temperature 146. If offsets 154 are not established for the current outdoor temperature 146 (e.g., or if offsets 154 have not been determined for longer than a threshold time), the controller 144 may proceed to determine (e.g., or update) the offsets 154 for the current outdoor temperature 146.

If one or more of the offsets 154 changes by greater than a threshold amount over a period of time, the controller 144 may determine that a fault is detected. For instance, if the blower 130 begins pulling outdoor air or air from a local unconditioned space (e.g., air from an attic or basement) through the HVAC system 100, an offset 154 may increase. The controller 154 may detect such a fault by (i) determining a difference between an updated offset 154 and a previous (e.g., an original) offset 154 for a given combination of outdoor temperature 146 and blower air flow rate 148, and (ii) determining that the difference is greater than a threshold value. If such a fault is detected, the controller 144 may provide an alert 142 for display on an interface of the thermostat 136 and/or for display on an another device to inform a maintenance provider of the detected fault.

Following establishment of the lookup table 152, the indoor temperature 140 may depart from the temperature setpoint 138 such that either heating or cooling mode operation is requested by the controller 144 and the HVAC system 100 begins to operate to provide heating or cooling as appropriate. During operation the HVAC system 100, a fault detection and/or system optimization protocol may request a measurement of the temperature of the return air 126. The HVAC system 100 generally lacks a sensor for measuring this temperature. However, in response to the request, the controller 144 may determine the current outdoor temperature 146 and blower air flow rate 148. This information may be used to select an appropriate temperature offset 154 (see FIG. 2 for reference). For example, if an offset 154 is stored for the current outdoor temperature 146 and blower air flow rate 148, this offset 154 may be selected for determining the return air temperature 156. Alternatively, if an offset 154 is stored for a temperature that is within a threshold range (e.g., of one or two degrees Fahrenheit of) the current outdoor temperature 146, then the offset 154 for the nearest outdoor temperature 146 may be selected. In some embodiments, any appropriate method of interpolation may be used to determine an appropriate offset 154 for a given combination of outdoor temperature 146 and blower speed 148. For example, referring to the example lookup table 152 of FIG. 2, if the blower air flow rate 148 is 1000 CFM and the outdoor temperature is 75° F., an offset 154 may be determined by interpolation between the established offsets 154 for outdoor temperatures 146 of 70° F. and 80° F. As an example, such an interpolated offset 154 may be 3.5° F. This example offset 154 at an outdoor temperature of 75° F. is determined based on:

$$\text{offset}(75^\circ\text{ F.}) = \text{offset}(70^\circ\text{ F.}) + (\text{offset}(80^\circ\text{ F.}) - \text{offset}(70^\circ\text{ F.}))\frac{(75^\circ\text{ F.} - 70^\circ\text{ F.})}{(80^\circ\text{ F.} - 70^\circ\text{ F.})}$$

The controller 144 may then use a measured indoor temperature 140 and the identified offset 154 to determine the return air temperature 156. For example, the offset 154 may be added to the indoor temperature 140 to determine the return air temperature 156. This determined return air temperature 156 may be provided to the protocol for appropriate further action. For example, results determined by the protocol using the return air temperature 156 may presented on a display of a thermostat 136. While the example of FIG. 1 employs the lookup table 152 to store appropriate offsets 154 for different operating conditions (e.g., of outdoor temperature 146 and blower air flow rate 148), it should be understood that one or more relationships (e.g., equations) may be determined and stored which relate the measured offsets 154 to the operating conditions of outdoor temperature 146 and blower air flow rate 148. Such relationships may subsequently be used to determine an appropriate offset 154 for a given combination of outdoor temperature 146 and blower air flow rate 148.

Example Methods of Determining and Using Temperature Offsets

Figure 3:
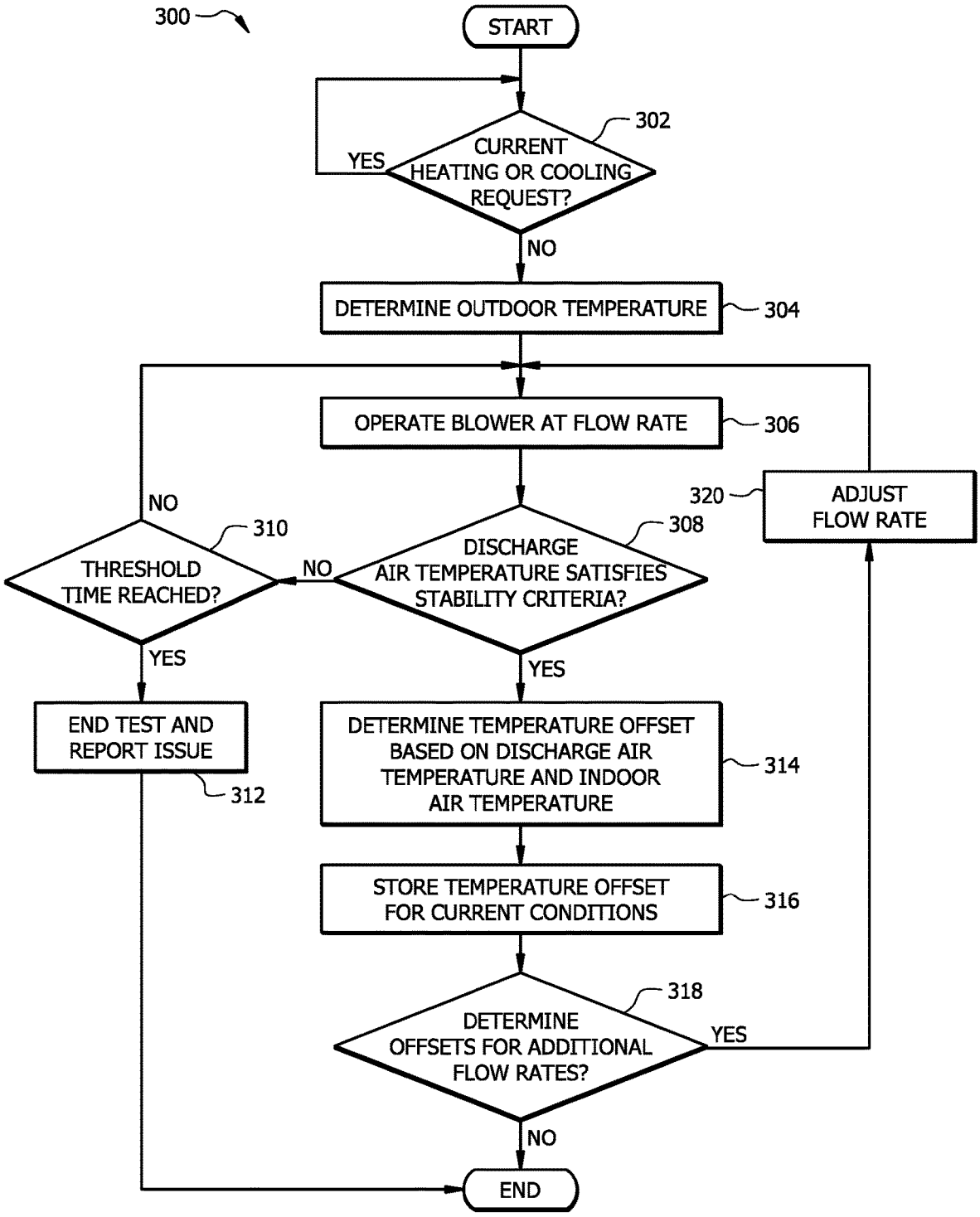
FIG. 3 is a flowchart of an example method of determining a lookup table for the HVAC system of FIG. 1.

FIG. 3 is a flowchart illustrating an example method 300 of generating the lookup table 152 of FIGS. 1 and 2. Method 300 generally facilitates the establishment of the lookup table 152 by determining one or more temperature offsets 154, which may be used at subsequent times to accurately determine return air temperature 156. The method 300 may begin at step 302 where the controller 144 determines whether there is current request for heating or cooling mode operation. For instance, the controller 144 may determine whether instructions are received from a thermostat 136 to operate in a heating mode or a cooling mode (e.g., based on relative values of the temperature setpoint 138 and indoor temperature 140 and/or a user-selected operating mode setting). In some embodiments, the controller 144 may determine that a request for heating or cooling has not been received for at least a threshold time (e.g., of at least ten minutes) before proceeding to step 304. This further requirement at step 302 may help ensure that the temperature measured by the discharge air temperature sensor 134*a* reflects the temperature of return air 126 without significant residual cooling by the evaporator 116 or heating by the heating element 118. If the controller 144 determines that heating or cooling mode operation is currently requested (e.g., or has been requested within the threshold time described above), the controller 144 generally returns to start (e.g., and waits a delay time of several seconds or longer before repeating step 302). Otherwise, if no heating or cooling is requested (e.g., or has not been requested for at least the threshold time described above), the controller 144 proceeds to step 304.

At step 304, the controller 144 determines the current outdoor temperature 146. The outdoor temperature 146 may be determined based on measurements from the outdoor temperature sensor 134*b*. For example, measurements of the outdoor temperature 146 may be provided (e.g., at any interval) by sensor 134*b* to the controller 144. Also or alternatively, a current outdoor temperature 146 (e.g., for the geographical area in which the HVAC system is located) may be provided by the weather data source 158.

At step 306, the controller 144 causes the blower 130 to provide a flow of air 120 through the HVAC system 100 at a flow rate 148. The flow rate 148 may be predetermined flow rate at which to establish an offset 154 for the HVAC system 100. In some embodiments, a set of flow rates 148 may be predetermined (see FIG. 2), and an initial flow rate 148 may be selected from the set of flow rates for step 306. In some embodiments, the initial flow rate 148 may be based on the amount of time that has passed since the temperature offset 154 was last updated for the current outdoor temperature 146. For example, the blower air flow rate 148 which has not been updated for the longest time may be selected as the initial blower speed 148.

While the blower 130 is operating at the flow rate 148, the controller 144 monitors the discharge air temperature 150 (i.e., based on measurements provided by sensor 134*a*) and determines whether the measured discharge air temperature 150 satisfy predefined stability criteria at step 308. For example, if the discharge air temperature 150 changes by less than 1° F. per minute (e.g., for at least 5 minutes), then the stability criteria may be satisfied at step 308. For example, the controller 144 may determine a first discharge air temperature 150 at a first time and a second discharge temperature 150 at a second time one minute later. If the difference between the first and second discharge air temperature 150 is less than 1° F., then the stability criteria may be satisfied at step 308. In some embodiments, these stability criteria may need to be satisfied for a threshold time (e.g., of five minutes, ten minutes, or the like). In some embodiments, the controller 144 may determine a rate of change of the discharge air temperature 150 over a period of time (e.g., of five minutes, ten minutes, or the like). If this rate of change (e.g., an average of the rate of change over the time period) is less than a threshold value (e.g., of 1° F./min), then the stability criteria may be satisfied at step 308. Generally, if the discharge air temperature 150 is stable (i.e., if the stability criteria are satisfied at step 308), then residual heat transfer between the flow of air 120 and the evaporator 116 and/or heating element 118 is negligible. Under these conditions the discharge air temperature 150 (i.e., of the flow of air 122) is approximately the same as (or within a threshold range of) the temperature of return air 126.

If the stability criteria are not satisfied at step 308, the controller 144 proceeds to step 310. At step 310, the controller 144 determines whether a threshold stabilization time (e.g., of five minutes, ten minutes, or the like) has been reached. If the threshold stabilization time has not been reached, the controller 144 generally returns to steps 306 and 308 and continues to operate the blower 130 and check whether the stabilization criteria become satisfied at step 308. If the threshold stabilization time is reached at step 310, the controller 144 proceeds to step 312 where the test is ended and the test failure is reported (e.g., as alert 142 of FIG. 1).

If the stability criteria are satisfied at step 308, the controller 144 proceeds to step 314. At step 314, the controller 144 determines the temperature offset 154 using the discharge air temperature 150 and the current indoor air temperature 140 (e.g., provided by the thermostat 136 and/or an associated indoor air temperature sensor). For instance, the offset 154 may be a difference between the discharge air temperature 150 and the indoor air temperature 140. At step 316, the controller 144 stores the offset 154 in the lookup table 152. For example, the offset 154 may be stored as an entry in the example lookup table 152 illustrated in FIG. 2 such that the offset 154 is associated with the blower air flow rate 148 at which the blower 130 is operated at step 306 and the current outdoor temperature 146.

At step 318, the controller 144 determines whether an offset 154 should be determined at different blower air flow rates 148. For example, the controller 144 may determine whether offsets 154 are available for the current outdoor temperature 146 and any other blower air flow rates 148 that are typically used by the blower 130 during heating and/or cooling mode operation of the HVAC system 100. If the controller 144 determines that additional offsets 154 should be measured at step 318, the controller 144 may proceed to adjust the blower air flow rate 148 at step 320 (e.g., to determine an offset 154 for another flow rate 148 in the lookup table 152 (see FIG. 2). The controller 144 then returns to step 306 to operate the blower 130 at the adjusted flow rate 148 and proceed through the steps described above. Offsets 154 may be determined at any number of appropriate different blower air flow rates 148 (e.g., at the different flow rates 148 that the blower 130 typically provides during normal heating and cooling mode operation of the HVAC system 100).

If the controller 144 determines that no additional offsets 154 should be measured at step 318, the method 300 generally ends. The method may be repeated again when the outdoor temperature 146 changes by a threshold amount (e.g., by at least one degree Fahrenheit), to determine offsets 154 for the different outdoor temperature 146. In some embodiments, the method 300 is repeated after greater than a threshold time has passed since a last update to the offsets 154 for a given outdoor temperature 146 in order to update offsets 154 for that outdoor temperature 146.

Modifications, additions, or omissions may be made to method 300 depicted in FIG. 3. Method 300 may include more, fewer, or other steps. For example, steps may be performed in parallel or in any suitable order. While at times discussed as controller 144, HVAC system 100, or components thereof performing the steps, any suitable HVAC system or components of the HVAC system may perform one or more steps of the method 300.

Figure 4:
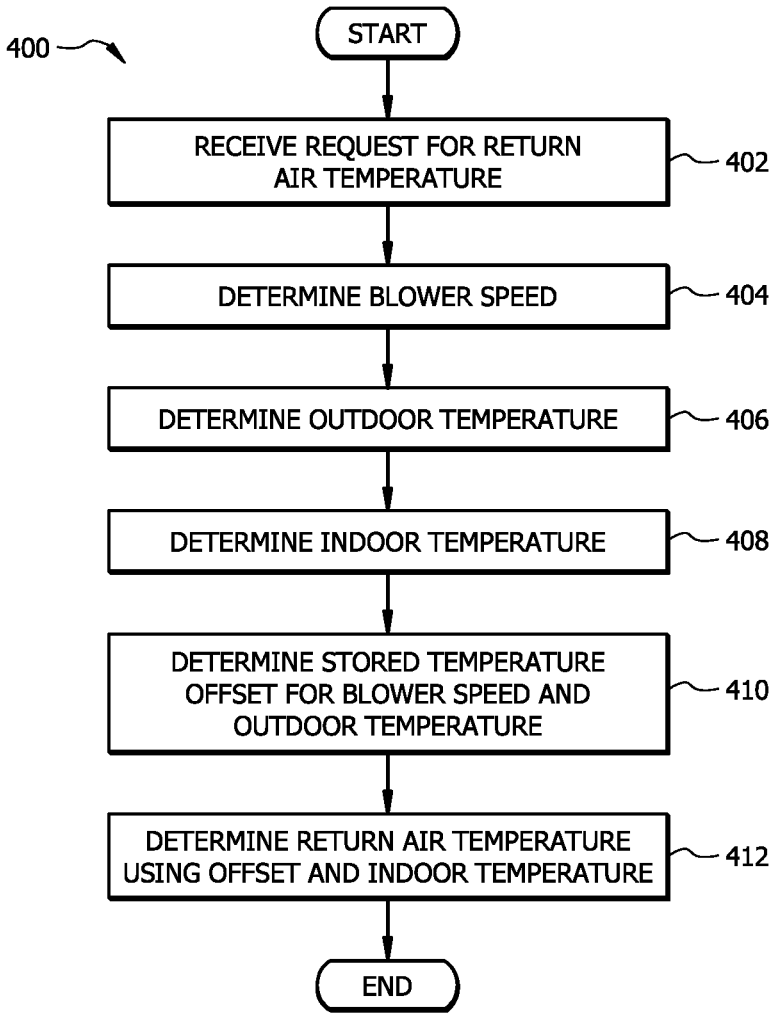
FIG. 4 is a flowchart of an example method of using a lookup table to determine return air temperature for the HVAC system of FIG. 1.

FIG. 4 is a flowchart illustrating an example method 400 for determining a return air temperature 156 for the HVAC system 100 illustrated in FIG. 1. Method 400 generally facilitates the determination of the return air temperature 156 without a return air temperature sensor using the lookup table 152 (e.g., as established using method 300 of FIG. 3, described above). The method 400 may begin at step 402 where the controller 144 receives a request for a return air temperature. For example, one or more fault detection and/or system optimization protocols may request a measurement of the temperature of the return air 126. The method 400 facilitates the determination of the return air temperature 156 when the HVAC system lacks a temperature sensor on, in, or near return duct 128.

At step 404, the controller 144 determines the blower air flow rate 148. For example, the blower 130 may provide information to the controller 144 indicating the current blower air flow rate 148. At step 406, the controller 144 determines the current outdoor temperature 146. The outdoor temperature 146 may be determined based on measurements from an outdoor temperature sensor **134*b*. For example, measurements of the outdoor temperature 146 may be provided (e.g., at any interval) by sensor 134*b* to the controller 144. Also or alternatively, a current outdoor temperature 146 (e.g., for the geographical area in which the HVAC system is located) may be provided by the weather data source 158 of FIG. 1. At step 408, the controller 144 determines the current indoor temperature 140. For example, the thermostat 136 may provide a measured value of the indoor temperature 140 to the controller 144**.

At step 410, the controller 144 determines, based on the current outdoor temperature 146 and the blower air flow rate 148, one or more offsets 154 to use to determine the return air temperature 156. For example, if an offset 154 is stored for the current outdoor temperature 146, this offset 154 may be selected at step 410. If an offset 154 is stored for a temperature that is within a threshold range (e.g., of one or two degrees Fahrenheit of) the current outdoor temperature 146, then the offset 154 for the nearest outdoor temperature 146 may be selected. As described above with respect to FIGS. 1 and 2, in some embodiments, any appropriate method of interpolation may be used to determine an appropriate offset 154 for a given combination of the blower air flow rate 148 (from step 404) and measured outdoor temperature 146 (from step 406).

At step 412, the controller 144 determines the return air temperature 156 using the offset determined at step 410 and the indoor temperature 140 determined at step 408. For example, the return air temperature 156 may be determined by adding the offset 154 to the current indoor temperature 140. The determined return air temperature 156 may then generally be used as appropriate (e.g., by any one or more fault detection and/or system optimization protocols).

Modifications, additions, or omissions may be made to method 400 depicted in FIG. 4. Method 400 may include more, fewer, or other steps. For example, steps may be performed in parallel or in any suitable order. While at times discussed as controller 144, HVAC system 100, or components thereof performing the steps, any suitable HVAC system or components of the HVAC system may perform one or more steps of the method 400.

Example Controller

Figure 5:
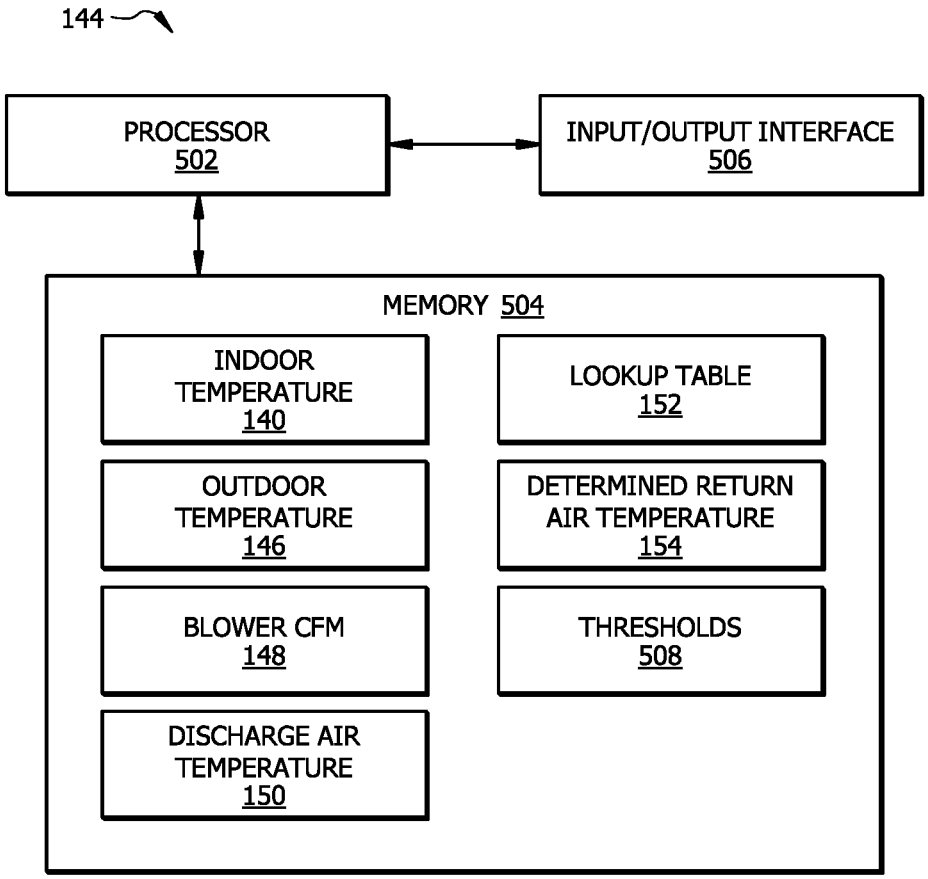
FIG. 5 is a diagram of an example controller of the HVAC system illustrated in FIG. 1.

FIG. 5 is a schematic diagram of an embodiment of the controller 144. The controller 144 includes a processor 502, a memory 504, and an input/output (I/O) interface 506.

The processor 502 includes one or more processors operably coupled to the memory 504. The processor 502 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 504 and controls the operation of HVAC system 100. The processor 502 may be a programmable logic device, a microcontroller, a microprocessor, or any suitable combination of the preceding. The processor 502 is communicatively coupled to and in signal communication with the memory 504. The one or more processors are configured to process data and may be implemented in hardware or software. For example, the processor 502 may be 8-bit, 16-bit, 32-bit, 64-bit or of any other suitable architecture. The processor 502 may include an arithmetic logic unit (ALU) for performing arithmetic and logic operations, processor registers that supply operands to the ALU and store the results of ALU operations, and a control unit that fetches instructions from memory 504 and executes them by directing the coordinated operations of the ALU, registers, and other components. The processor 502 may include other hardware and software that operates to process information, control the HVAC system 100, and perform any of the functions described herein (e.g., with respect to FIGS. 3 and 4). The processor 502 is not limited to a single processing device and may encompass multiple processing devices. Similarly, the controller 144 is not limited to a single controller but may encompass multiple controllers.

The memory 504 includes one or more disks, tape drives, or solid-state drives, and may be used as an over-flow data storage device, to store programs when such programs are selected for execution, and to store instructions and data that are read during program execution. The memory 504 may be volatile or non-volatile and may include ROM, RAM, ternary content-addressable memory (TCAM), dynamic random-access memory (DRAM), and static random-access memory (SRAM). The memory 504 is operable (e.g., or configured) to store measured indoor temperatures 140, outdoor temperatures 146, blower air flow rates 148, discharge air temperatures 150, lookup tables 152, temperature offsets 154, determined return air temperatures 156, thresholds 508 (i.e., including any of the threshold values, predefined time periods, and the like described above with respect to FIGS. 1-4), and/or any other logic and/or instructions for performing the function described in this disclosure (e.g., including for implementing a fault detection and/or performance optimization protocol, as described above with respect to FIGS. 1-4).

The I/O interface 506 is configured to communicate data and signals with other devices. For example, the I/O interface 506 may be configured to communicate electrical signals with components of the HVAC system 100 including the compressor 106, fan 110, expansion device 114, heating element 118, sensors 134*a,b*, blower 130, and thermostat(s) 136. The I/O interface may provide and/or receive, for example, compressor speed signals blower speed signals, temperature signals, relative humidity signals, thermostat calls, temperature setpoints, environmental conditions, and an operating mode status for the HVAC system 100 and send electrical signals to the components of the HVAC system 100. The I/O interface 506 may include ports or terminals for establishing signal communications between the controller 144 and other devices. The I/O interface 506 may be configured to enable wired and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system, the HVAC system comprising:

a blower configured to provide a flow of air through at least one air duct and into a conditioned space;

a temperature sensor configured to measure a discharge air temperature of the flow of air provided to the conditioned space; and a controller configured to:

cause the blower to provide the flow of air at a first flow rate;

receive, from the temperature sensor over a first period of time, measurements of the discharge air temperature;

determine that the measured discharge air temperature satisfies predefined stability criteria associated with a change in the discharge air temperature during the first period of time being less than a threshold value;

in response to determining that the measured discharge air temperature satisfies the predefined stability criteria, determine a first temperature offset comprising a difference between the discharge air temperature and an indoor temperature;

determine a first outdoor temperature; and store, in a memory of the controller, the first temperature offset associated with the first flow rate of the flow of air provided by the blower and the first outdoor temperature.

2. The HVAC system of claim 1, the controller further configured to, following determining the first temperature offset:

cause the blower to provide the flow of air at a second flow rate, wherein the second flow rate is different than the first flow rate;

receive, from the temperature sensor over a second period of time, measurements of the discharge air temperature;

determine that the measured discharge air temperature satisfies the predefined stability criteria over the second period of time;

in response to determining that the measured discharge air temperature satisfies the predefined stability criteria, determine a second temperature offset comprising a second difference between the discharge air temperature and the indoor temperature; and store, in the memory of the controller, the second temperature offset associated with the second flow rate of the flow of air provided by the blower and the first outdoor temperature.

3. The HVAC system of claim 1, the controller further configured to, prior to determining the first temperature offset:

determine that a previous temperature offset is not stored for the first flow rate of air provided by the blower and the first outdoor temperature; and in response to determining that the previous temperature offset is not stored for the first flow rate of air provided by the blower and the first outdoor temperature, proceed with determining the first temperature offset.

4. The HVAC system of claim 1, the controller further configured to, prior to determining the first temperature offset:

determine that a previous temperature offset is stored in the memory for the first flow rate of air provided by the blower and the first outdoor temperature;

determine a time difference between when the previous temperature offset was determined and a current time; and in response to determining that the determined time difference is greater than a threshold value, proceed with determining the first temperature offset.

5. The HVAC system of claim 1, the controller further configured to, following storing the first temperature offset:

cause operation of the HVAC system in a cooling or heating mode;

during operation of the HVAC system in the cooling or heating mode:

determine a current flow rate of the air provided by the blower is the first flow rate;

determine a current outdoor temperature, wherein the current outdoor temperature is within a threshold temperature range of the first outdoor temperature;

identify the first temperature offset as being associated with the first flow rate and the current outdoor temperature;

determine a current indoor temperature; and determine a return air temperature using the current indoor temperature and the identified first temperature offset.

6. The HVAC system of claim 1, the controller further configured to:

determine that the measured discharge air temperature fails to satisfy the predefined stability criteria; and in response to determining that the measured discharge air temperature fails to satisfy the predefined stability criteria, provide an alert indicating the failure.

7. The HVAC system of claim 1, the controller further configured to determine that the measured discharge air temperature satisfies the predefined stability criteria by:

determining a rate of change of the discharge air temperature over the first period of time; and determining that the measured rate of change is less than a threshold value.

8. A method of operating a heating, ventilation, and air conditioning (HVAC) system, the method comprising, by a controller of the HVAC system:

causing a blower to provide a flow of air at a first flow rate, wherein the flow of air is provided through at least one air duct of the HVAC system and into a conditioned space;

following causing the blower to provide the flow of air at the first flow rate, receiving, over a first period of time, measurements of the discharge air temperature from a temperature sensor positioned and configured to measure a discharge air temperature of the flow of air provided to the conditioned space;

determining that the measured discharge air temperature satisfies predefined stability criteria associated with a change in the discharge air temperature during the first period of time being less than a threshold value;

in response to determining that the measured discharge air temperature satisfies the predefined stability criteria, determining a first temperature offset comprising a difference between the discharge air temperature and an indoor temperature;

determining a first outdoor temperature; and storing, in a memory of the controller, the first temperature offset associated with the first flow rate of the flow of air provided by the blower and the first outdoor temperature.

9. The method of claim 8, further comprising, following determining the first temperature offset:

causing the blower to provide the flow of air at a second flow rate, wherein the second flow rate is different than the first flow rate;

receiving, from the temperature sensor over a second period of time, measurements of the discharge air temperature;

determining that the measured discharge air temperature satisfies the predefined stability criteria over the second period of time;

in response to determining that the measured discharge air temperature satisfies the predefined stability criteria, determining a second temperature offset comprising a second difference between the discharge air temperature and the indoor temperature; and storing, in the memory of the controller, the second temperature offset associated with the second flow rate of the flow of air provided by the blower and the first outdoor temperature.

10. The method of claim 8, further comprising, prior to determining the first temperature offset:

determining that a previous temperature offset is not stored for the first flow rate of air provided by the blower and the first outdoor temperature; and in response to determining that the previous temperature offset is not stored for the first flow rate of air provided by the blower and the first outdoor temperature, proceeding with determining the first temperature offset.

11. The method of claim 8, further comprising, prior to determining the first temperature offset:

determining that a previous temperature offset is stored in the memory for the first flow rate of air provided by the blower and the first outdoor temperature;

determining a time difference between when the previous temperature offset was determined and a current time; and in response to determining that the determined time difference is greater than a threshold value, proceeding with determining the first temperature offset.

12. The method of claim 8, further comprising, following storing the first temperature offset:

causing operation of the HVAC system in a cooling or heating mode;

during operation of the HVAC system in the cooling or heating mode:

determining a current flow rate of the air provided by the blower is the first flow rate;

determining a current outdoor temperature, wherein the current outdoor temperature is within a threshold temperature range of the first outdoor temperature;

identifying the first temperature offset as being associated with the first flow rate and the current outdoor temperature;

determining a current indoor temperature; and determining a return air temperature using the current indoor temperature and the identified first temperature offset.

13. The method of claim 8, further comprising:

determining that the measured discharge air temperature fails to satisfy the predefined stability criteria; and in response to determining that the measured discharge air temperature fails to satisfy the predefined stability criteria, providing an alert indicating the failure.

14. The method of claim 8, further comprising determining that the measured discharge air temperature satisfies the predefined stability criteria by:

determining a rate of change of the discharge air temperature over the first period of time; and determining that the measured rate of change is less than a threshold value.

15. A controller of a heating, ventilation, and air conditioning (HVAC) system, the controller comprising:

an input/output interface communicatively coupled to:

a blower configured to provide a flow of air through at least one air duct and into a conditioned space; and a temperature sensor configured to measure a discharge air temperature of the flow of air provided to the conditioned space; and a processor coupled to the input/output interface, the processor configured to:

cause the blower to provide the flow of air at a first flow rate;

following causing the blower to provide the flow of air at the first flow rate, receive, from the temperature sensor over a first period of time, measurements of the discharge air temperature;

determine that the measured discharge air temperature satisfies predefined stability criteria associated with a change in the discharge air temperature during the first period of time being less than a threshold value;

in response to determining that the measured discharge air temperature satisfies the predefined stability criteria, determine a first temperature offset comprising a difference between the discharge air temperature and an indoor temperature;

determine a first outdoor temperature; and store, in a memory of the controller, the first temperature offset associated with the first flow rate of the flow of air provided by the blower and the first outdoor temperature.

16. The controller of claim 15, the processor further configured to, following determining the first temperature offset:

cause the blower to provide the flow of air at a second flow rate, wherein the second flow rate is different than the first flow rate;

receive, from the temperature sensor over a second period of time, measurements of the discharge air temperature;

determine that the measured discharge air temperature satisfies the predefined stability criteria over the second period of time;

in response to determining that the measured discharge air temperature satisfies the predefined stability criteria, determine a second temperature offset comprising a second difference between the discharge air temperature and the indoor temperature; and store, in the memory of the controller, the second temperature offset associated with the second flow rate of the flow of air provided by the blower and the first outdoor temperature.

17. The controller of claim 15, the processor further configured to, prior to determining the first temperature offset:

determine that a previous temperature offset is not stored for the first flow rate of air provided by the blower and the first outdoor temperature; and in response to determining that the previous temperature offset is not stored for the first flow rate of air provided by the blower and the first outdoor temperature, proceed with determining the first temperature offset.

18. The controller of claim 15, the processor further configured to, prior to determining the first temperature offset:

determine that a previous temperature offset is stored in the memory for the first flow rate of air provided by the blower and the first outdoor temperature;

determine a time difference between when the previous temperature offset was determined and a current time; and in response to determining that the determined time difference is greater than a threshold value, proceed with determining the first temperature offset.

19. The controller of claim 15, the processor further configured to, following storing the first temperature offset:

cause operation of the HVAC system in a cooling or heating mode;

during operation of the HVAC system in the cooling or heating mode:

determine a current flow rate of the air provided by the blower is the first flow rate;

determine a current outdoor temperature, wherein the current outdoor temperature is within a threshold temperature range of the first outdoor temperature;

identify the first temperature offset as being associated with the first flow rate and the current outdoor temperature;

determine a current indoor temperature; and determine a return air temperature using the current indoor temperature and the identified first temperature offset.

20. The controller of claim 15, the processor further configured to:

determine that the measured discharge air temperature fails to satisfy the predefined stability criteria; and in response to determining that the measured discharge air temperature fails to satisfy the predefined stability criteria, provide an alert indicating the failure.

* * * * *